US005192378A

United States Patent [19]

Doherty et al.

[11] Patent Number: 5,192,378

[45] Date of Patent: Mar. 9, 1993

[54] ALUMINUM ALLOY SHEET FOR FOOD AND BEVERAGE CONTAINERS

[75] Inventors: Roger D. Doherty, Wynnewood; John Liu, Lower Burrell; Robert E. Sanders, Jr., New Kensington, all of Pa.

[73] Assignee: Aluminum Company of America, Pittsburgh, Pa.

[21] Appl. No.: 611,982

[22] Filed: Nov. 13, 1990

[51] Int. Cl.[5] ..... C22F 1/04

[52] U.S. Cl. ..... 148/691; 148/692; 148/693; 148/697; 148/700; 148/417; 148/439; 206/139

[58] Field of Search ..... 148/2, 11.5 A, 159, 148/417, 439, 691, 692, 693, 697, 700; 206/139; 420/533, 534

[56] References Cited

U.S. PATENT DOCUMENTS

| | | | |
|---|---|---|---|
| 4,282,044 | 8/1981 | Robertson et al. | 148/11.5 A |
| 4,284,437 | 8/1981 | Baba et al. | 148/11.5 A |
| 4,501,627 | 2/1985 | Althoff | 148/437 |
| 4,502,900 | 3/1985 | Althoff | 148/440 |
| 4,605,448 | 8/1986 | Baba et al. | 148/11.5 A |
| 4,637,842 | 1/1987 | Jeffrey et al. | 148/12.7 |
| 4,645,544 | 2/1987 | Baba et al. | 148/12.7 |
| 4,707,195 | 11/1987 | Tsuchida et al. | 148/11.5 A |
| 4,753,685 | 6/1988 | Usui et al. | 148/2 |

FOREIGN PATENT DOCUMENTS

| | | |
|---|---|---|
| 121620 | 10/1984 | European Pat. Off. . |
| 282162 | 9/1988 | European Pat. Off. . |
| 292411 | 11/1988 | European Pat. Off. . |
| 54-066313 | 5/1979 | Japan . |
| 55-044592 | 3/1980 | Japan . |
| 55-050105 | 12/1980 | Japan . |
| 57-149459 | 9/1982 | Japan . |
| 57-057550 | 12/1982 | Japan . |
| 57-057551 | 12/1982 | Japan . |
| 58-126967 | 7/1983 | Japan . |
| 60-258454 | 12/1985 | Japan . |
| 61-019705 | 5/1986 | Japan . |
| 61-288055 | 12/1986 | Japan . |
| 61-288056 | 12/1986 | Japan . |
| 62-003231 | 1/1987 | Japan . |
| 62-013421 | 3/1987 | Japan . |
| 62-230945 | 10/1987 | Japan . |
| 62-054183 | 11/1987 | Japan . |
| 62-263954 | 11/1987 | Japan . |
| 63-028850 | 2/1988 | Japan . |
| 63-149349 | 6/1988 | Japan . |
| 63-282245 | 11/1988 | Japan . |
| 63-282246 | 11/1988 | Japan . |
| 63-065745 | 12/1988 | Japan . |
| 64-068439 | 3/1989 | Japan . |
| 1-123054 | 5/1989 | Japan . |

*Primary Examiner*—John P. Sheehan
*Assistant Examiner*—Robert R. Koehler
*Attorney, Agent, or Firm*—Andrew Alexander; David W. Pearce-Smith

[57] ABSTRACT

Disclosed is a method for making an aluminum alloy sheet having controlled levels of strength properties for forming into a container panel. A body of an aluminum alloy consisting essentially of 0.45 to 0.60 wt. % Cu, 1.1 to 1.7 wt. % Mg, 0.3 to 0.6 wt. % Si, 0.3 to 0.55 wt. %. Fe, 0.5 to 1.2 wt. % Mn, the remainder aluminum, incidental elements and impurities, is hot rolled to a gauge in the range of 0.12 to 0.16 inch to provide a hot rolled product. The hot rolled product is cold rolled to provide a reduction of 50 to 80% in thickness, then solution heat treated in a range of 850° to 110° F. and rapidly cooled before cold rollign to a final sheet gauge by providing a reduction of 30 to 90% in thickness.

42 Claims, 3 Drawing Sheets

EFFECT OF SOLUTION HEAT TREAT TEMPERATURE

SOLUTE ENHANCED WORK HARDENING
OF INVENTION ALLOY

ALUMINUM ALLOY SHEET FOR FOOD AND BEVERAGE CONTAINERS

BACKGROUND OF THE INVENTION

This invention relates to containers such as food and beverage containers. More specifically, this invention relates to an alloy and sheet product for forming into food and beverage containers.

The present invention provides an aluminum base alloy, sheet products and method of fabricating the sheet product from the alloy. Further, the invention provides containers, such as food and beverage containers, formed from the sheet products wherein the containers have end walls and sidewalls formed from the same alloy, and yet the end walls can have a higher strength than the sidewalls.

SUMMARY OF THE INVENTION

A principal object of the invention is to provide an aluminum alloy sheet product particularly for forming into panels for containers such as food and beverage containers.

A further object of the present invention is to provide aluminum alloy sheet products having the same alloy composition suitable for end walls and sidewalls of food and beverage containers.

Yet a further object of the present invention is to provide aluminum alloy sheet products from the same alloy for end walls and sidewalls of food and beverage containers where the sheet product for the end wall has a higher strength than the sheet product for sidewalls.

Still a further object of the invention is to provide a method for processing an aluminum alloy into sheet products for fabricating into food and beverage containers.

And still a further object is to provide a food and beverage container having an end wall and a sidewall formed from the same aluminum alloy wherein the end wall has a higher strength than the sidewall.

These and other objects will become apparent from a reading of the specification and claims and an inspection of the claims appended hereto.

In accordance with these objects, there is provided an alloy sheet product for container panels such as end and sidewall panels and other container components such as tabs for easy open end containers. The alloy contains, in wt.%, 0.3 to 0.6 Cu, 1.4 to 1.7 Mg, 0.3 to 0.5 Si, 0.3 to 0.55 Fe, 0.5 to 1.2 Mn, the remainder aluminum, incidental elements and impurities. The process of the invention includes hot rolling a body of the alloy to a gauge in the range of about 0.12 to 0.16 inch to provide a hot rolled product, cold rolling the hot rolled product to provide a reduction of about 50 to 80% in thickness, and solution heat treating the cold rolled product in a temperature range of about 800° to 1100° F. Thereafter, the product is rapidly cooled and then cold rolled to a final sheet gauge by providing a reduction of about 30 to 90% in thickness. The product may be subjected to different solution heat treatments or cold rolling reductions depending on the level of strength desired in the container end or wall.

DETAILED DESCRIPTION OF THE PREFERRED EMBODIMENTS

Figure 1:
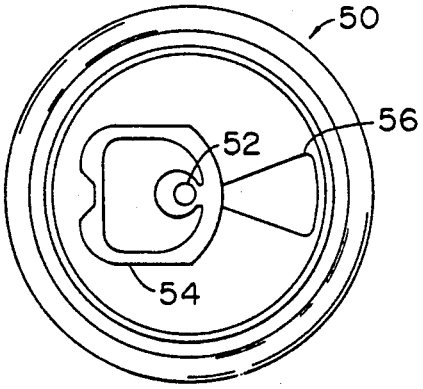
FIG. 1 is a top view of an easy open end or lid.

As noted, the alloy of the present invention comprises, in wt.%, 0.3 to 0.6 Cu, 1.1 to 1.7 Mg. 0.3 to 0.7 Si, 0.1 to 0.55 Fe, 0.5 to 1.2 Mn, the talance aluminum, incidental elements and impurities. Impurities are preferably limited to 0.05 wt.% each, and the combination of impurities preferably should not exceed 0.15 wt.%. The sum total of incidental elements and impurities preferably does not exceed 0.35 wt.%.

A preferred alloy would contain 0.3 to 0.6 wt.% Cu, 1.4 to 1.7 wt.% Mg, 0.3 to 0.6 wt.% Si, 0.3 to 0.55 wt.% Fe, 0.8 to 1.2 wt.% Mn, the balance aluminum, incidental elements and impurities. Elements such as Ti preferably have a maximum of 0.1 wt.% and Cr 0.2 wt.%. A typical alloy composition would contain about 0.5 wt.% Cu, 1.5 wt.% Mg, 0.5 wt.% Si, 0.4 wt.% Fe and 1.1 wt.% Mn.

Fe contributes to or aids in grain size control. The amount of Fe should be carefully controlled because excess Fe can lead to forming problems. That is, Fe, particularly in combination with Mn, can lead to the formation of coarse primary constituents which result in forming problems.

Mn which contributes to strength also contributes to constituent formation and aids in recrystallization control through formation of dispersoid.

Mg, Si and Cu are the main strengthening elements and are effective in contributing to strength by solute-enhanced work hardening.

During rolling, dislocations or distortions in the crystal lattice are generated and move to accommodate the shape change. In the absence of solute elements or low levels of solute elements, e.g., Cu, Mg and Si, the dislocations dynamically recover and form subgrain boundaries which result in less hardening of the material or less strength in the material. The presence of higher levels of Cu, Mg and Si hinders the dynamic recovery process and gives rise to rapid work hardening. It is the creating of this microstructure having a high density of dislocations which are maintained in the alloy that is important to the present invention. That is, by controlling the formation of the microstructure, aluminum alloy sheet can be formed having high strength and low formability suitable for forming into container ends or having lower strength and higher formability suitable for forming into container bodies. This is accomplished when strengthening dislocations introduced by rolling, for example, are immobilized by their interaction with the extra solutes, e.g., Cu, Mg and Si. This mechanism which can be controlled by cold working or solutionizing is significantly more effective in strengthening the alloy sheet. The mechanism may be referred to as solute-enhanced work hardening and can be used to develop different properties so as to enable balance or control of strength and formability, depending on the end use of the alloy.

As well as providing the alloy product with controlled amounts of alloying elements as described herein, it is preferred that the alloy be prepared according to specific method steps in order to provide the most desirable characteristics of both strength and formability as required for container ends or bodies. That is, lower strength and higher formability can be provided for sheet used for forming container bodies. Higher strength and lower formability can be provided for container ends. Thus, the alloy as described herein can be provided as an ingot or slab for fabrication into a suitable wrought product by casting techniques currently employed in the art for cast products with continuous casting being preferred. Slabs resulting from belt casters or roll casters may be used. Prior to the principal working operation, the alloy stock is preferably subjected to homogenization. The homogenization is preferably carried out at a metal temperature in the range of 900° to 1080° F. for a period of time of at least 1 hour to dissolve soluble elements and to homogenize the internal structure of the metal. A preferred time period is about 4 hours or more in the homogenization temperature range. Normally, the heatup and homogenizing treatment does not have to extend for more than 8 hours, however, longer times are not normally detrimental. 4 to 6 hours at the homogenization temperature has been found to be quite suitable. A typical homogenization temperature is in the range of 1020° to 1080° F., and a typical time in this temperature range is about 4 hours. After homogenization, the ingot is hot worked or hot rolled to provide an intermediate gauge. Hot rolling is performed wherein the starting temperature for rolling is in the range of 700 to 975° F. When the use of the alloy is for end stock or body stock, the hot rolling is performed to provide an intermediate product having a thickness in the range of about 0.12 inch to 0.19 inch. Thereafter, the intermediate product may then be annealed by heating between about 500° to 700° F. for a period of time sufficient to recrystallize the internal structure. However, for reasons of texture (earing) control, the anneal step is optional depending upon the hot rolling conditions used to produce the sheet which may be self annealed. The material is then cold rolled to provide a reduction in thickness of about 20 to 70%, typically 40 to 60%. Such reduction provides sheet in the range of 0.014 to 0.050 inch.

After cold rolling, the sheet is then subjected to a solution heat treatment in the range of about 750° to 1100° F. When the sheet is to be used for a food and beverage type container bodies (body stock) which can have an integral bottom and sidewall formed by drawing and ironing, for example, the solution heat treatment should be performed in the range of 750° to 1050° F., preferably 800° to about 1010° or 1020° F. The solution heat treatment process is an important aspect of this invention because it aids in obtaining the necessary balance between strength and formability of the final sheet product which is so important to the present invention. The heatup rate for the solution heat treatment should be not less than 1° F./sec, preferably, 5° F./sec with faster heatup rates not presently known to be detrimental.

When the use of the final sheet product is for lids or end panels (end stock) such as an easy-open ends where the combination of higher strength and lower formability is important, then the solution heat treatment step should be carried out at a higher temperature range. Thus, the solution heat treatment for end stock should be in the range of 900° to 1110° F., preferably 1000° to 1050° F. The heatup rate of the metal for the solution heat treatment should not be less than 1° F./sec, preferably not less than 5° F./sec, with faster heat rates not known to be detrimental.

Solution heat treatment in accordance with the present invention may be performed on a continuous basis, and the time at the heat treating temperature must be closely controlled so as to avoid grain growth and reduced formability. Basically, solution effects can occur fairly rapidly, for instance in as little as one to ten seconds, once the metal has reached a solution temperature. In continuous treating, the sheet is passed continuously as a single web through an elongated furnace which greatly increases the heatup rate. The continuous approach facilitates practice of the invention since a relatively rapid heatup and short dwell time at solution temperature result in maintaining a finer grain size. Accordingly, the inventors contemplate solution heat treating in as little as about 10 minutes, or less, for instance about 0.5 to 4 minutes, with times of about 1 to 2 minutes at the solution heat treating temperature being quite suitable. As a further aid to achieving a short heatup time, a furnace temperature or a furnace zone temperature significantly above the desired metal temperatures provides a greater temperature head useful to speed heatup times.

After solution heat treatment of either the end stock or can body stock, it is important that the metal be rapidly cooled to prevent or minimize the uncontrolled precipitation of $Mg_2Si$ and other phases. Thus, it is preferred in the practice of the invention that the quench rate be at least 10° F./sec from solution temperature to a temperature of 350° F. or lower. A preferred quench rate is at least 30° F./sec in the temperature range of 1100° F. or more to 350° F. or less. Suitable rates can be achieved with the use of water, e.g., water immersion or water jets. Further, air or air jete may be employed. Preferably, the quenching takes place or. a continuous basis. Conforming to these solution heat treatment controls greatly aids the production of end stock or body stock having higher strength and lower formability for the end and lower strength and higher formability for the wall of the bodly particularly using the alloy composition of the invention.

The solution heat treated and quenched product may be cold rolled to final sheet gauge using a reduction of 30 to 90% in thickness. However, when the use of the final sheet is container bodies for food and beverage type containers, then not only strength but formability is also important. Formability is particularly important because the blank for the body may be drawn and redrawn or drawn and ironed making severe demands on the formability, yet because it is desirable to lighten the weight of the container by having a thinner wall, strength is also very important. Thus, when the use of the final sheet is body stock, cold rolling is utilized to provide a reduction of 30 to 70% in thickness. This amount of cold work preferably combined with the preferred solution heat treatment for body stock provides a very suitable level of strength and formability for making a container body. Typically for body stock, the thickness in the final gauge is in the range of 0.008 to 0.012 inch.

When the use of sheet is for end stock, cold rolling is utilized to provide a reduction in the range of 50 to 90% in thickness of the solution heat treated and quenched product. This amount of cold work increases the strength of the end stock. Further, when this amount of cold work is combined with the preferred solution heat treatment for end stock, then even more significant increases in strength are obtained where higher strength is desired for the container end.

Body stock produced as herein described can have a range of yield strength of 40 to 52 ksi, typically 42 to 48 ksi after the final cold rolling step.

End stock produced as herein described can have a range of yield strength of from about 46 to 60 ksi, typically 48 to 54 ksi after the final rolling step.

Figure 2:
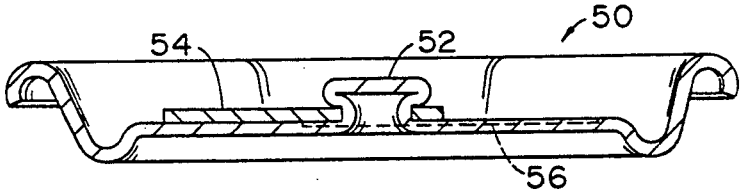
FIG. 2 is a cross-sectional view of FIG. 3 in accordance with the invention.
Figure 3:
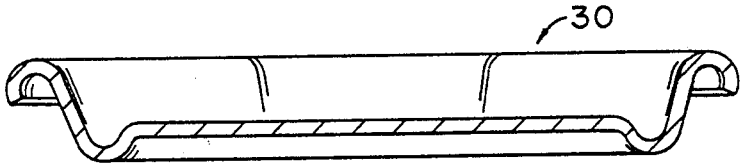
FIG. 3 is a cross section of a container panel or lid in accordance with the invention.
Figure 4:
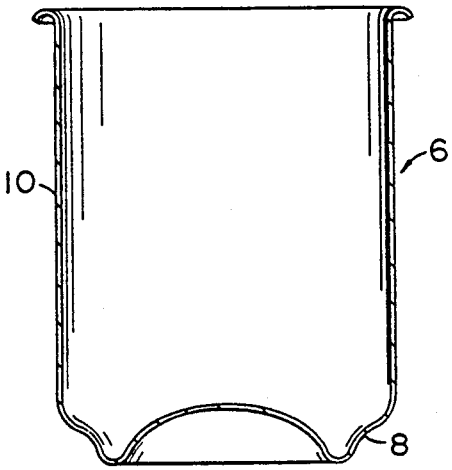
FIG. 4 illustrates a food or beverage container in accordance with the invention.

Representative shapes of container ends or lids which may be formed from the end stock are shown in FIGS. 1, 2 and 3, and representative of container bodies which may be formed from the body stock are shown in FIG. 4. Container body 6 has a wall 10 and may have an integral aluminum bottom 8. A polymer layer is bonded to the inside of aluminum wall 10. Normally, the polymer layer is applied to the container (and cured) after container forming and cleaning operations. For lids or ends, normally the polymer layer is applied to the sheet stock and cured before cutting blanks and forming into lids, as shown in FIGS. 1, 2 and 3.

The polymer layer is baked in a temperature range of 350° to 490° F. for purposes of curing. Such baking has the effect of lowering the yield strength of both ends and container body walls about 2.0 to 5.0 ksi. However, the ultimate tensile strength increases in the range cf 1.0 to 6.0 ksi after the polymer baking operations. Care should be exercised in baking to prevent precipitation of phases such as $CuMgAl_2$ phases because this can operate to reduce material strength.

By the use of "end panel" or "end wall" herein is meant to include container lids or ends, including easy open ends which have an integral rivet, top and score-line.

By the use of "sidewall" or "sidewall panel" as used herein is meant to include the sidewall of a food or beverage type container and can include the bottom, particularly when it is formed integrally with the sidewall as shown in FIG. 4, for example.

By the use of "container panel" is meant to include end panels and sidewall panels.

The lid or end design may be conventional type 30 as shown in FIG. 3 or it may be a conventional type with an opening therein for sealing with an adhesive strip. Or, the lid design may be any of the easy open type 50 (FIGS. 1 and 2) having an integral rivet 52, a tab 54 and a score line 56 defining an opening for removing contents from the container. Further, the lid or end 30 or 50 may be made by any of the well known stamping or forming processes to provide the type 30 design.

For containers as shown in FIG. 4, for example, the final sheet gauge is provided in the range of 0.011 to 0.015 inch. Thereafter, blanks cut from the sheet stock are typically cupped, wall ironed, bottom domed, necked and flanged to provide the container body.

Thus, food and beverage containers having ends or lids thereon can be made from the alloy of the invention. Yet, the alloy can be processed to provide a balance between strength and formability. The lid can be processed to provide higher strength. Yet, the body stock can be processed to provide for formability as by drawing and ironing with a strength suitable for a food and beverage type container. Further, tab 54 can be fabricated from this alloy and processed to the required level of strength for tab stock. Because the can bodies and ends and even tab stock can be made from the same alloy, this unique feature greatly facilitates recycling of aluminum containers because there is no need to segregate the bodies and ends as is required when different alloys are used.

EXAMPLE 1

Figure 5:
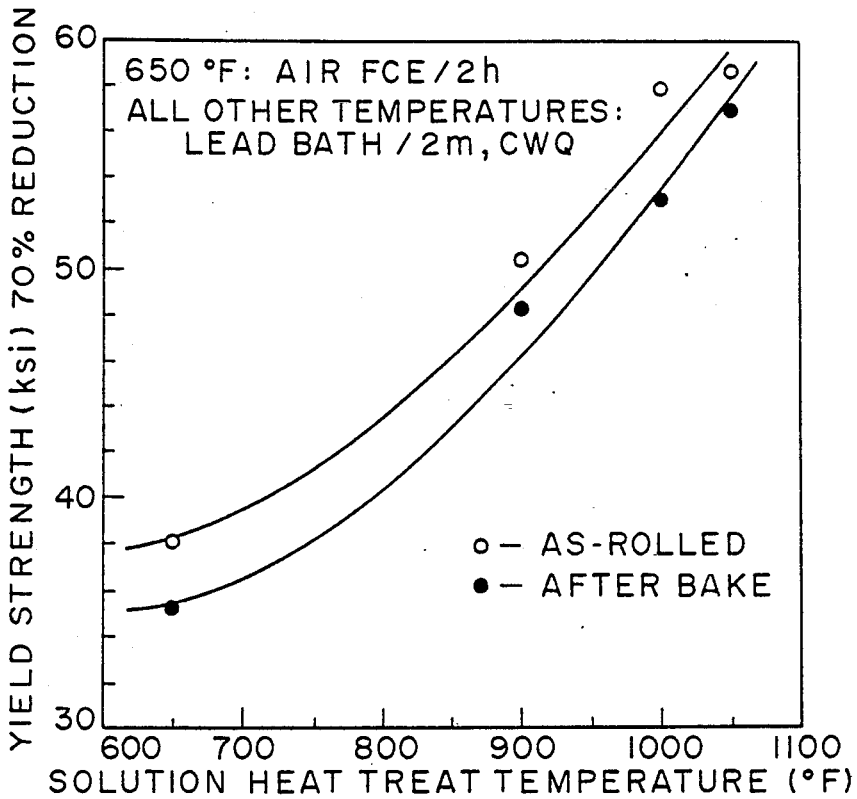
FIG. 5 is a graph showing the improvement in tensile yield strength with temperature.

An aluminum alloy having 0.42 wt.% Si, 0.42 wt.% Fe, 0.51 wt.% Cu, 1.01 wt.% Mn and 1.5 wt.% Mg, the remainder aluminum, incidental elements and impurities, was cast into an ingot 24 inches by 54 inches by 180 inches and homogenized by heating to between 1055° to 1080° F. The ingot was kept at this temperature for 4 hours and then slowly cooled to 930° F. over 14 hours and then air cooled to 900° F. Thereafter, the ingot was hot rolled starting at 900° F. and reduced from 24 inches to 1.1 inch and then further reduced by hot rolling to 0.12 inch. The coil was batch annealed at 650° F. for 2 hours and then cold rolled by reducing the thickness 70%. Samples were then solution heat treated at 650°, 900°, 1000° and 1050° F.; the 650° F. annealing treatment was for 2 hours and air cooled, the higher temperature solution heat treatments were for 2 minutes and cold water quenched. Thereafter, each of these samples were cold rolled again to provide a second 70% reduction in thickness to a sheet having a thickness of 0.011 inch. The effect of varying the solution heat treatment is shown in FIG. 5. After the last cold rolling treatment, the samples were baked at 400° F. for 20 minutes with a resultant small drop in yield strength.

EXAMPLE 2

Figure 6:
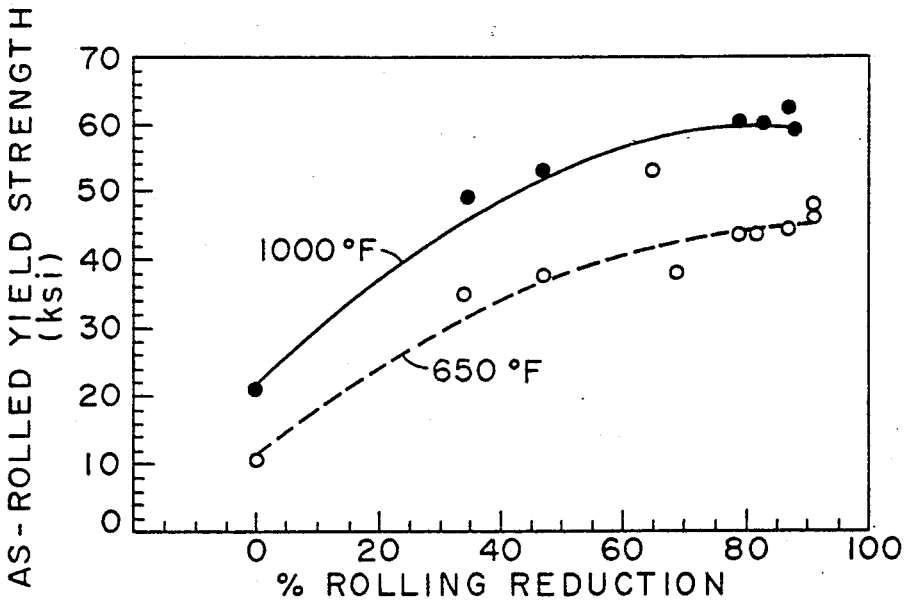
FIG. 6 is a graph showing the improvement in yield strength resulting from cold rolling reductions.
Figure 7:
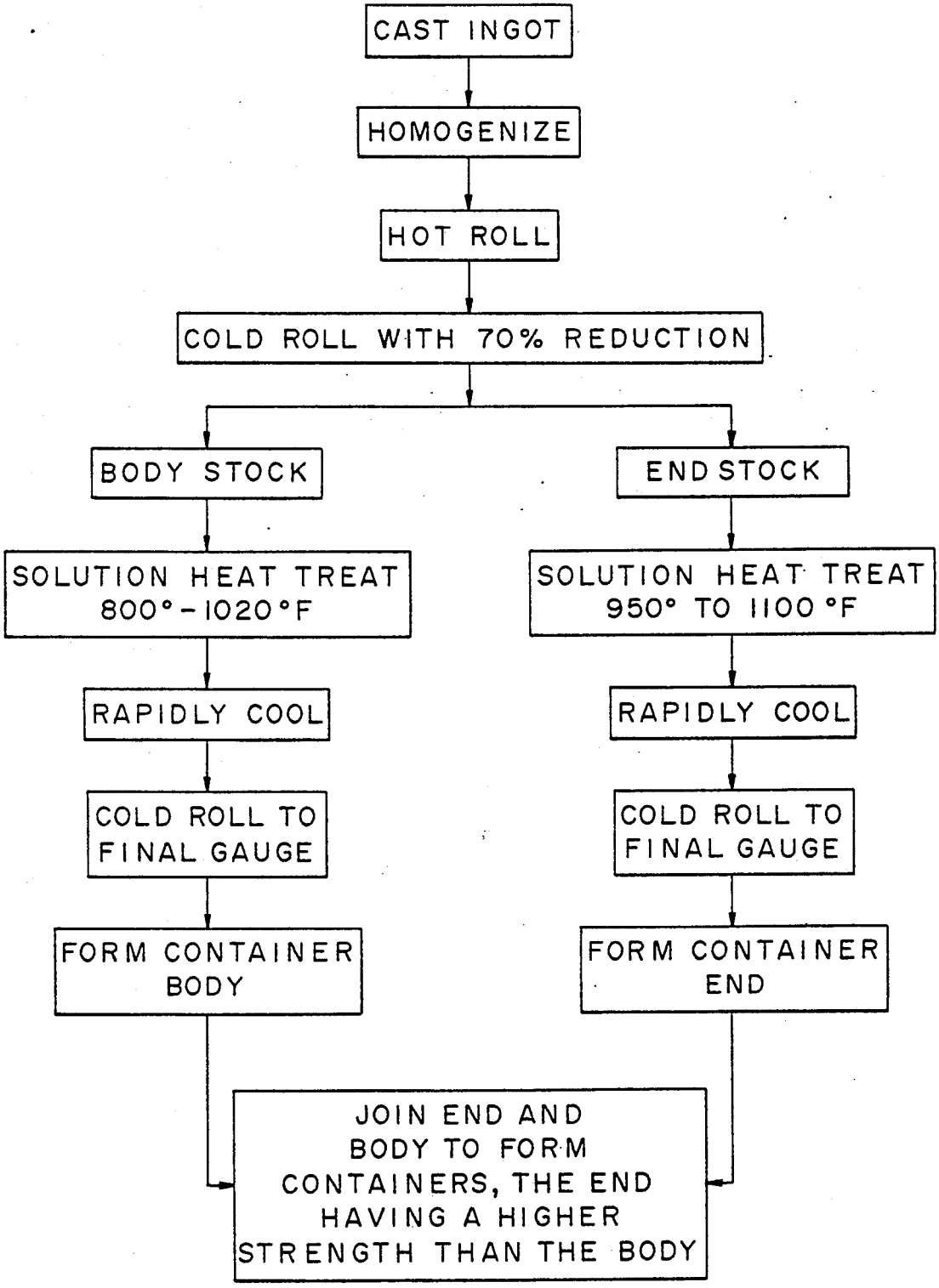
FIG. 7 is a flowsheet showing the process of the invention.

This example was the same as Example 1 except that after the first cold rolling step, all of the samples were solution heat treated at 1000° F., then subjected to cold rolling reduction of about 0, 33, 46, 64, 77, 82 and 87. It will be noted that the percentage cold work increased the yield strength compared to similar samples treated at 650° F. for 2 hours (see FIG. 6).

If percentage cold work and solution heat treatments are combined, even higher strengths can be obtained.

Having thus described the invention, what is claimed is:

1. A method of making an aluminum alloy sheet having a strength in the range of 55 to 60 ksi for forming into container panels for container ends comprising:

(a) providing a body of an aluminum alloy consisting essentially of 0.45 to 0.60 wt.% Cu, 1.1 to 1.7 wt.% Mg, 0.3 to 0.6 wt.% Si, 0.3 to 0.55 wt.% Fe, 0.5 to 1.2 wt.% Mn, the remainder aluminum, incidental elements and impurities;

(b) hot rolling said body to a gauge to provide a hot rolled product;

(c) cold rolling said hot rolled product to provide a reduction of 50 to 80% in thickness;

(d) solution heat treating said cold rolled product in a range of 800° to 1020° F.;

(e) rapidly cooling said solution heat treated product; and (f) cold rolling said cooled product to final sheet gauge by providing a reduction of 50 to 90% in thickness.

2. The method in accordance with claim 1 wherein the hot rolled has a thickness of 0.12 to 0.16 inch.

3. The method in accordance with claim 1 wherein the solution heat treatment is in the range of 850° to 1010° F.

4. The method is accordance with claim 1 wherein the solution heat treated product is cold water quenched.

5. The method in accordance with claim 1 wherein the cold rolling provides a sheet gauge in the range of 0.008 to 0.012 inch.

6. A method of making an aluminum alloy container having an end and a sidewall fabricated from the same alloy and having different strength properties, the method comprising:

(a) providing a body of an aluminum alloy consisting essentially of 0.45 to 0.60 wt.% Cu, 1.1 to 1.7 wt.% Mg, 0.3 to 0.6 wt.% Si, 0.3 to 0.55 wt.% Fe, 0.5 to 1.2 wt.% Mn, the remainder aluminum, incidental elements and impurities;

(b) hot rolling said body to a hot rolled product;

(c) cold rolling said hot rolled product to provide a reduction of 50 to 80% in thickness;

(d) solution heat treating said cold rolled product in a range of 800° to 1020° F. suitable for sheet used for said sidewall;

(e) rapidly cooling said solution heat treated product;

(f) cold rolling said cooled product to a final sheet by providing a reduction of 30to 90% in thickness, said sheet being suitable for use for said sidewalls and a strength in the range of 55 to 60 ksi;

(g) providing solution heat treated and cold rolled sheet having the composition in step (a) suitable for use for said ends and a strength in the range of 46 to 60 ksi; and (h) forming said sheet resulting from steps (f) and (g) into said wall portion and said end and connecting said sidewall and end to provide a container having an end having a higher strength than said sidewall.

7. The method in accordance with claim 6 wherein the hot rolled product has a thickness of 0.12 to 0.16 inch.

8. The method in accordance with claim 6 wherein the solution heat treatment is in the range of 850° to 1010° F.

9. The method in accordance with claim 6 wherein the solution heat treated product is cold water quenched.

10. The method in accordance with claim 6 wherein the cold rolling in step (f) provides a reduction of 30 to 70% in thickness to provide sheet for container bodies.

11. The method in accordance with claim 6 wherein in step (f) the sheet gauge in the range of 0.008 to 0.012 inch.

12. The method in accordance with claim 6 wherein in step (g) the cold rolled sheet results from a cold rolling reduction in thickness of 50 to 90%.

13. A method of making an aluminum alloy container having an end and a sidewall fabricated from the same alloy, the end having a higher tensile strength than the sidewall, the method comprising:

(a) providing a body of an aluminum alloy consisting essentially of 0.45 to 0.60 wt.% Cu, 1.1 to 1.7 wt.% Mg, 0.3 to 0.6 wt.% Si, 0.3 to 0.55 wt.% Fe, 0.5 to 1.2 wt.% Mn, the remainder aluminum, incidental elements and impurities;

(b) hot rolling said body to a gauge in the range of 0.12 to 0.16 inch to provide a hot rolled product; provide a hot rolled product;

(c) cold rolling said hot rolled product to provide a reduction of 50 to 80% in thickness;

(d) solution heat treating said cold rolled product in a range of 800° to 1020° F.;

(e) rapidly cooling said solution heat treated product; and (f) cold rolling said cooled product to provide a reduction in thickness of 30 to 70% to sheet to be used for said sidewall, said sheet having a strength in the range of 46–60 ksi;

(g) providing cold rolled, solution heat treated and rapidly cooled sheet having the composition in step (a), the cold rolled sheet resulting from a reduction in thickness of 50 to 90% to sheet for said end; and (h) forming said sheet resulting from steps (f) and (g) into said wall portion and said end and connecting said sidewall and end to provide a container having an end having a higher strength than said sidewall.

14. The method in accordance with claim 13 wherein in step (d) the solution heat treatment is in the range of 850° to 1020° F.

15. The method in accordance with claim 13 wherein in step (f) the sheet has a thickness in the range of 0.008 to 0.012 inch.

16. The method in accordance with claim 13 wherein in step (g) the sheet has a strength in the range of 46 to 60 ksi.

17. A method of making an aluminum alloy container having an end and a sidewall fabricated from the same alloy and the end having a higher tensile strength than said sidewall-the method comprising:

(a) providing a body of an aluminum alloy consisting essentially of 0.45 to 0.60 wt.% Cu, 1.1 to 1.7 wt.% Mg, 0.3 to 0.6 wt.% Si, 0.3 to 0.55 wt.% Fe, 0.5 to 1.2 wt.% Mn, the remainder aluminum, incidental elements and impurities;

(b) hot rolling said body to a gauge in the range of 0.12 to 0.16 inch to provide a hot rolled product;

(c) cold rolling said hot rolled product to provide a reduction of 50 to 80% in thickness;

(d) solution heat treating said cold rolled product in a range of 800° to 1020° F. suitable for sheet used for said sidewall;

(e) rapidly cooling said solution heat treated product;

(f) cold rolling after rapidly cooling to provide a reduction in thickness of 30 to 70% to sheet for said sidewall, said sheet having a strength in the range of 46–60 ksi;

(g) providing a solution heat treated and cold rolled sheet having the composition in step (a) suitable for sheet used for said ends, the solution heat treatment having been in the range of 950° to 1100° F. and the cold rolled sheet resulting from a cold rolling reduction in thickness of 50 % to 90%; and (h) forming said sheet from steps (f) and (g) into said sidewall and said end and connecting said sidewall and end to provide said container having an end having a higher strength that said sidewall.

18. The method in accordance with claim 17 wherein the solution heat treatment is 850° to 1010° F.

19. The method in accordance with claim 17 wherein in step (f) the cold rolled sheet has a thickness of 0.008 to 0.012 inch.

20. The method in accordance with claim 17 wherein in step (g) the sheet has a strength in the range of 55 to 60 ksi.

21. In a method of producing a container having a sidewall having a yield strength greater than 46 ksi and an end having a yield strength between 55–60 ksi wherein a single aluminum alloy product is formed to produce said sidewall and said end, the end having a higher strength than said sidewall, the improvement wherein said product is provided as an alloy consisting essentially of 0.45 to 0.60 wt.% Cu, 1.1 to 1.7 wt.% Mg, 0.3 to 0.6 wt.%, 0.3 to 0.55 wt.% Fe, 0.5 to 1.2 wt.% Mn, the remainder aluminum, incidental elements and impurities, said product further being provided in the condition resulting from:

(a) hot rolling said body to a hot rolled product;
(b) cold rolling said hot rolled product to provide a reduction of 50 to 80% in thickness;
(c) solution heat treating said cold rolled product in a range of 850° to 1020° F.;
(D) rapidly cooling said solution heat treated product; and
(e) cold rolling said cooled product to a final sheet gauge by providing a reduction of 30 to 90% in thickness.

22. The method in accordance with claim 21 wherein the hot rolling is to a thickness of 0.12 to 0.16 inch.

23. The method in accordance with claim 21 wherein the solution heat treating is in the range of 850° to 1010° F.

24. The method in accordance with claim 21 wherein the cold rolling in step (e) provides a reduction of 30 to 70% in thickness to provide sheet for container bodies.

25. The method in accordance with claim 21 wherein the cold rolling provides a sheet gauge in the range of 0.008 to 0.012 inch.

26. The method in accordance with claim 21 wherein the cold rolling in step (e) provides a reduction of 50 to 90% in thickness to provide sheet for container ends.

27. In a method of producing a plural panel container having an end panel having a yield strength between 55 and 60 ksi and a side panel having a yield strength greater than 46 ksi, said panels formed from the same alloy and connected together along peripheral portions of said end panel, said side panel being formed from sheet having a strength lower than sheet from which said end panel is formed, the improvement wherein said sheet is provided as an alloy consisting essentially of 0.45 to 0.60 wt.% Cu, 1.1 to 1.7 wt.% Mg, 0.3 to 0.6 wt.%, Si, 0.3 to 0.55 wt.% Fe, 0.5 to 1.2 wt.% Mn, the remainder aluminum, incidental elements and impurities, said product further being provided in the condition resulting from:

(a) hot rolling said body to a hot rolled product;
(b) cold rolling said hot rolled product to provide a reduction of 50 to 80% in thickness;
(c) solution heat treating said cold rolled product in a range of 850° to 1020° F.;
(d) rapidly cooling said solution heat treated product; and
(e) cold rolling said cooled product to sheet by providing a reduction of 30 to 90% in thickness.

28. The method in accordance with claim 27 wherein the hot rolling is to a thickness of 0.12 to 0.16 inch.

29. The method in accordance with claim 27 wherein the solution heat treating is in the range of 850° to 1010° F.

30. The method in accordance with claim 27 wherein the cold rolling in step (e) provides a reduction of 30 to 70% in thickness to provide sheet for container bodies.

31. The method in accordance with claim 27 wherein the cold rolling provides a sheet gauge in the range of 0.008 to 0.012 inch.

32. The method in accordance with claim 27 wherein the cold rolling in step (e) provides a reduction of 50 to 90% in thickness to provide sheet for container ends.

33. In a method of producing a plural panel container having an end panel and a side panel formed from the same alloy and connected together along peripheral portions of said end panel, said side panel being formed from sheet having a strength lower than sheet from which said end panel is formed, the improvement wherein said product is provided as an alloy consisting essentially of 0.45 to 0.60 wt.% Cu, 1.1 to 1.7 wt.% Mg, 0.3 to 0.6 wt.%, 0.3 to 0.55 wt.% Fe, 0.5 to 1.2 wt.% Mn, the remainder aluminum, incidental elements and impurities, said product further being provided in the condition resulting from:

(a) hot rolling said body to a gauge in the range of 0.12 to 0.16 inch to provide a hot rolled product;
(b) cold rolling said hot rolled product to provide a reduction of 50 to 80% in thickness;
(c) solution heat treating said cold rolled product in a range of 850° to 1020° F. for sheet used for said sidewall;
(d) rapidly cooling said solution heat treated product; and
(e) cold rolling said cooled product to a final sheet gauge by providing a reduction of 30 to 90% in thickness to produce sheet having a yield strength greater than 46 ksi;
(f) providing solution heat treated and cold rolled sheet having the above composition suitable for said end panel; and
(g) forming said sheet resulting from steps (e) and (f) into said wall portion and said end panel and connecting said sidewall and end panel to provide said container, said sheet used for said end having a tensile yield strength in the range of 2 to 15 ksi greater than the tensile yield strength of the sheet used in the body panel.

34. The method in accordance with claim 33 wherein the solution heat treatment is in the range of 850° to 1010° F.

35. The method in accordance with claim 33 wherein the solution heat treated product is cold water quenched.

36. The method in accordance with claim 33 wherein the cold rolling in step (e) provides a reduction of 30 to 70% in thickness to provide sheet for container bodies.

37. The method in accordance with claim 33 wherein the cold rolling provides a sheet gauge in the range of 0.008 to 0.012 inch.

38. The method in accordance with claim 33 wherein the cold rolled sheet in step (f) results from a cold rolling reduction of 50 to 90% in thickness to provide sheet for container ends.

39. In a method of producing a plural panel container having an end panel and a side panel formed from the same alloy and connected together along peripheral portions of said end panel, said side panel being formed from sheet having a strength lower than sheet from which said end panel is formed, the improvement wherein said product is provided as an alloy consisting essentially of 0.45 to 0.60 wt.% Cu, 1.1 to 1.7 wt.% Mg, 0.3 to 0.6 wt.%, 0.3 to 0.55 wt.% Fe, 0.5 to 1.2 wt.% Mn, the remainder aluminum, incidental elements and impurities, said product further being provided in the condition resulting from:

(a) hot rolling said body to a gauge in the range of 0.12 to 0.16 inch to provide a hot rolled product;
(b) cold rolling said hot rolled product to provide a reduction of 50 to 80% in thickness;

(c) solution heat treating said cold rolled product in a range of 850° to 1020° F.;

(d) rapidly cooling said solution heat treated product; and (e) cold rolling said cooled product to a final sheet gauge by providing a reduction of 30 to 70% to a final sheet gauge for sheet to be used for said sidewall, said sheet having a yield strength greater than 46 ksi;

(f) providing solution heat treated and cold rolled sheet having the above composition suitable for said end panel; the cold rolled sheet resulting from a reduction in thickness of 50 to 90%; and (g) forming said sheet resulting from steps (e) and (f) into said side panel and said end panel and connecting said side panel and end panel to provide said container, the side panel having a lower tensile strength than the end panel.

40. The method in accordance with claim 39 wherein the solution heat treatment is in the range of 850° to 1010° F.

41. The method in accordance with claim 39 wherein in step (e) the sheet has a thickness in the range of 0.008 to 0.012 inch.

42. The method in accordance with claim 39 wherein in step (f) the sheet has a strength in the range of 55 to 60 ksi.

* * * * *

UNITED STATES PATENT AND TRADEMARK OFFICE

CERTIFICATE OF CORRECTION

PATENT NO. : 5,192,378

DATED : March 9, 1993

INVENTOR(S) : Roger D. Doherty, John Liu and Robert E. Sanders

It is certified that error appears in the above-indentified patent and that said Letters Patent is hereby corrected as shown below:

On the title page, Abstract line 12, change "rollign" to --rolling--;
Column 6, line 65, Claim 2, after "rolled", insert --product--;
Column 8, line 22, Claim 16, change "46" to --48--;
Column 8, line 54, Claim 17, change "that" to --than--;
Column 9, line 3, Claim 21, after "0.6 wt.%", insert --Si--;
Column 9, line 50, Claim 27, change "1020°F" to --1100°F--;
Column 10, line 7, Claim 33, change "product" to --sheet--;
Column 10, line 9, Claim 33, change after "0.6 wt.%", insert --Si--;
Column 10, line 18, change "850" to --800--;
Column 10, line 21, Claim 33, delete "and";
Column 10, line 34, Claim 33, change "2" to --9--;
Column 10, line 59, change "product" to --sheet--;
Column 10, line 61, after "0.6 wt.%", insert --Si--;
Column 11, line 2, change "850" to --800--;
Column 11, line 4, delete "and";
Column 11, line 6, after "product", delete "to a final sheet gauge by providing a reduction" and insert therefor --to provide a reduction in thickness--.
Column 11, line 11, after "providing", insert --a--.
Column 11, line 12, after "composition", delete "suitable".

Signed and Sealed this

Thirty-first Day of May, 1994

Bruce Lehman

*Attest:*

BRUCE LEHMAN

*Attesting Officer*

*Commissioner of Patents and Trademarks*